US005765421A

United States Patent [19]

Slade et al.

[11] Patent Number: 5,765,421

[45] Date of Patent: Jun. 16, 1998

[54] USE OF A STUB MANDREL AND COILING SPOOL IN A REVERSING ROLLING MILL APPLICATION

[75] Inventors: Philip J. Slade; Roland N. Hequet, both of Pittsburgh, Pa.

[73] Assignee: Kvaerner U.S. Inc., Pittsburgh, Pa.

[21] Appl. No.: 743,318

[22] Filed: Nov. 5, 1996

[51] Int. Cl.[6] ..... B21C 47/00; B21B 41/06

[52] U.S. Cl. ..... 72/148; 72/229

[58] Field of Search ..... 72/148, 229, 225, 72/224, 183, 231, 146; 242/596.7, 598.3, 599.2

[56] References Cited

U.S. PATENT DOCUMENTS 3,426,892 2/1969 Poncy .

4,019,359 4/1977 Smith ..... 72/146

4,695,008 9/1987 Dabrowski .

4,697,757 10/1987 Nakaya et al. .

*Primary Examiner*—Lowell A. Larson

*Assistant Examiner*—Rodney Butler

*Attorney, Agent, or Firm*—Armstrong, Westerman, Hattori, McLeland & Naughton

[57] ABSTRACT

In the rolling of e.g. metal strip, an entry reel is provided in the form of a stub mandrel having two opposed and spaced-apart arms with reduced diameter end portions, rolling the strip and evacuating a tail end of the strip from the entry reel, placing a coiling spool over the reduced diameter portions of the arms of the stub mandrel, reversing the rolling direction of the mill, gripping the last rolled end of the strip on the coiling spool, again rolling the strip, and coiling the rolled strip on the coiling spool.

8 Claims, 1 Drawing Sheet

USE OF A STUB MANDREL AND COILING SPOOL IN A REVERSING ROLLING MILL APPLICATION

BACKGROUND OF THE INVENTION

1. Field of the Invention

This invention relates to the use of a coiling spool with a stub mandrel in a reversing rolling mill.

2. Description of the Prior Art

A stub mandrel is one having two opposed and spaced apart arms which can be moved toward and away from each other to enter or exit the eye of a coil of rolled material such as steel to handle the coil and serve as a reel from which the coiled material may be uncoiled for rolling. Such mandrels are expandable, e.g. by mechanical or hydraulic means, so as to hold the mandrel tightly within the coil eye and rotate with the coil. The use of stub mandrel entry reels in non-reversing rolling mills is old in the art. Sheet and strip (hereinafter called"strip") materials, such as metals, e.g. steel, cannot be easily recoiled on the same such mandrel, so that rolling mills equipped with such mandrels are capable of only one pass of strip through the mill. The present solution to convert a reversing rolling mill equipped with a stub mandrel entry reel is to replace the stub mandrel with a new reel equipped with a full face mandrel.

A stub mandrel has been used, as an enrty reel, with a sleeve extending between the opposed arms of the mandrel in the case of non-reversing rolling of very thin material which when coiled would collapse without the supporting means provided by the sleeve between the spaced apart arms of the stub mandrel.

SUMMARY OF THE INVENTION

The invention provides a method of using a stub mandrel as an entry reel in a reversing rolling mill application, by uncoiling strip from the stub mandrel, rolling the strip and coiling it on an exit reel with the tail end of the strip evacuated from the entry reel, then positioning a coiling spool on the stub mandrel, thereby creating a full face mandrel, and finally reversing the mill, gripping the head end of the strip on the spool, and rerolling the strip and coiling it on the stub mandrel-mounted spool which now serves as an exit reel.

DESCRIPTION OF PREFERRED EMBODIMENTS

Figure 1:
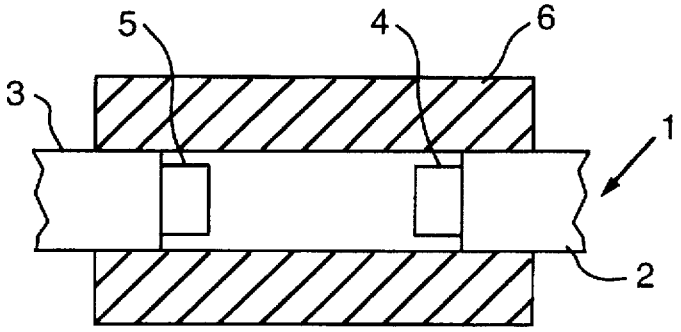
FIG. 1 is a plan cross-section of a coil with a stub mandrel entry reel positioned for unwinding the coiled material.
Figure 2:
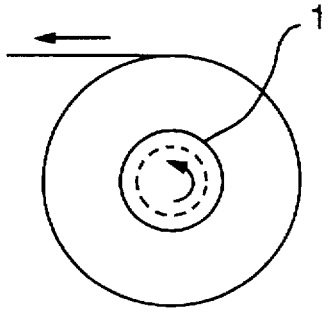
FIG. 2 is an end view of the coil and mandrel of FIG. 1, showing material being uncoiled from the mandrel.
Figure 3:
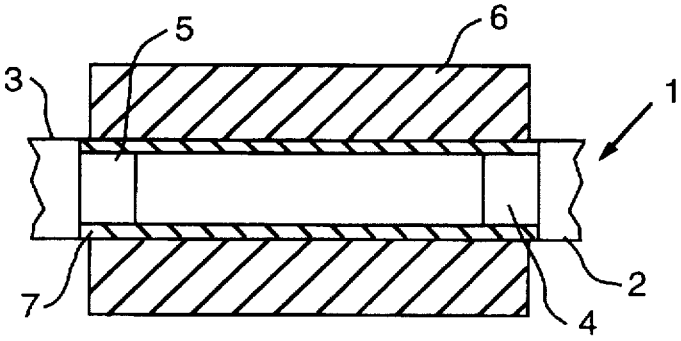
FIG. 3 is a plan cross-section of a coil and a coiling spool positioned over the stub mandrel, forming a full face mandrel suitable for use as an exit reel onto which rolled material can be coiled.
Figure 4:
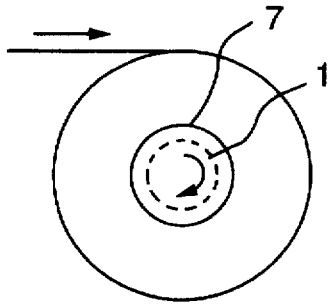
FIG. 4 is an end view of the device of FIG. 3 showing rolled material being coiled on the mandrel-mounted spool.

FIG. 1 shows a stub mandrel generally denoted by the numeral 1, having opposed arms 2 and 3 provided with reduced diameter end portions 4 and 5, respectively. A coil 6 of strip is mounted on the mandrel 1, acting as an entry reel, and, as shown in FIG. 2, may be unwound for threading into the rolling stand(s) of a reversing rolling mill, such as a mill as shown in a co-pending application for a Two Stand Cold Reduction Reversing Mill, filed on Oct. 10, 1996, by Norbert Monier, which application is incorported herein by this reference.

After first pass rolling is completed, and the rolled material is coiled on an exit reel (not shown) with the tail end evacuated from the entry reel, a coiling spool 7 is placed over the reduced diameter portions 4, 5 of mandrel arms 2 and 3 such that the ends of the coiling spool come against the mandrel arms 2 and 3. The outer surface of the coiling spool may be flush with the outer surface of the larger diameter portion of the mandrel arms 2 and 3. The mill then is reversed and the tail end of the rolled strip, now forming the head end of the strip to be rolled again, is gripped on the thus-modified entry reel, for example by means of a conventional belt wrapper, or a built-in gripper as shown in copending application Ser. No. 08/743,839 filed Nov. 5th 1996, in the names of Philip J. Slade and Roland N. Hequet for Coiler Spool with Built-In Gripper Slot, which application is incorporated herein by this reference. Expansion of the stub mandrel against the inside of the spool 7 holds the spool in place, preventing both rotation and axial translation of the spool with respect to the stub mandrel. Strip 6 then is rolled in a second pass through the reversing mill and coiled on spooi 7.

Use of the spool 7, mounted on the stub mandrel 1, as above shown and described, allows the use of a stub mandrel as both an entry reel and an exit reel in reversing mill operation, and thereby saves the trouble and expense of replacing the stub mandrel with a new, separate, full face mandrel for coiling strip when mill rolling direction is reversed.

What is claimed is:

1. A method of operating a reversing rolling mill in the rolling of elongated strip, comprising providing as an entry reel a stub mandrel having a pair of opposed and spaced-apart arms for entering the eye of a coil of strip and holding the coil, uncoiling strip from the entry reel and rolling the strip until a tail end of the strip is evacuated from the entry reel, placing a tubular coiling spool over the stub mandrel to provide a full face mandrel, reversing the rolling direction of the mill, gripping the last rolled end of the strip on the entry reel, again rolling the strip through the mill, and coiling the rolled strip on the coiling spool.

2. A method according to claim 1, further comprising providing each of the arms of the stub mandrel with a reduced diameter end portion, and placing the coiling spool over the reduced diameter end portions of the arms of the stub mandrel.

3. A method according to claim 2, wherein a distance from an outside surface of the reduced diameter portion of each arm to the outside surface of a full diameter portion of each arm is substantially equal to a thickness of the wall of the coiling spool.

4. A method according to claim 3, wherein the mandrel is an expandable stub mandrel, and during reverse rolling the mandrel is expanded to hold the coiling spool tightly against the reduced diameter portions of the mandrel arms, thereby preventing axial and rotating motion of the coiling spool relative to the stub mandrel.

5. A method according to claim 1, wherein the rolling mill is a two-stand reversing cold mill.

6. A method according to claim 2, wherein the rolling mill is a two-stand reversing cold mill.

7. A method according to claim 3, wherein the rolling mill is a two-stand reversing cold mill.

8. A method according to claim 4, wherein the rolling mill is a two-stand reversing cold mill.

* * * * *